US006042985A

United States Patent [19]

Matsuda et al.

[11] Patent Number: 6,042,985

[45] Date of Patent: Mar. 28, 2000

[54] IMAGE FORMING METHOD AND RECORDING MEDIUM USED THEREFOR

[75] Inventors: Tsukasa Matsuda; Yuichi Fukuda; Tetuso Yamada; Takayuki Yamashita, all of Nakai-machi, Japan

[73] Assignee: Fuji Xerox Co., Ltd., Tokyo, Japan

[21] Appl. No.: 09/121,554

[22] Filed: Jul. 23, 1998

[30] Foreign Application Priority Data

Aug. 15, 1997 [JP] Japan ..... 9-220465

[51] Int. Cl.[7] ..... G03G 13/16

[52] U.S. Cl. ..... 430/126; 430/99

[58] Field of Search ..... 430/126, 99

[56] References Cited

U.S. PATENT DOCUMENTS

| | | | |
|---|---|---|---|
| 5,308,773 | 5/1994 | Rimai et al. | 430/126 |
| 5,370,961 | 12/1994 | Zaretsky et al. | 430/126 |
| 5,805,969 | 9/1998 | Elserman's et al. | 430/126 |

FOREIGN PATENT DOCUMENTS

| | | |
|---|---|---|
| 63-92965 | 4/1988 | Japan . |
| 5-216322 | 8/1993 | Japan . |
| 5-273781 | 10/1993 | Japan . |

*Primary Examiner*—John Goodrow

*Attorney, Agent, or Firm*—Oliff & Berridge, PLC

[57] ABSTRACT

Provided is an image forming method, in which image glossiness is the same as a recording medium regardless of the values of an image density or an image area percentage, especially an image excellent in not only color reproducibility but granularity is obtained and in addition, no cracks are produced in the surface layer of the recording medium after the image is formed, and a recording medium preferably used in the method.

The method comprises the steps of: forming a toner image on an image carrier; placing the image formed on the image carrier on a transparent thermoplastic resin layer of a recording medium in a close contact condition, wherein the transparent thermoplastic resin layer is provided at a surface roughness (Ra) of 1.0 $\mu$m or less on an opaque base of the recording medium; and heating the toner image thus placed in the close contact condition to transfer and fix the image on the transparent resin layer. The image carrier is heated to a surface temperature thereof higher than a softening point (Tmt) of a toner before the image carrier reaches a toner image transfer position and the recording medium is preferably separated from the toner image carrier when a temperature of the transparent resin of the surface of the recording medium is lower than the softening point (Tmp) by more than 10° C. at a position downstream of the toner image transfer position.

14 Claims, 9 Drawing Sheets

IMAGE FORMING METHOD AND RECORDING MEDIUM USED THEREFOR

BACKGROUND OF THE INVENTION

1. Field of the Invention

The present invention relates to an image forming method in which not only is a toner image formed by an indirect electrophotographic method transferred on a recording medium, but an excellent glossiness and a good image quality can be provided for an image quality in the transfer by a printer, a copy machine or the like which employs a simultaneous transfer/fixing system and to a recording medium preferably used for the method.

2. Description of the Related Art

In recent years, color image forming with use of a digital indirect electrophotographic method has been widely practiced. In the digital indirect dry electrophotographic method, in general, toners of respective colors of yellow, magenta, cyan and black prepared by mixing coloring materials such as a pigment or dye into a thermoplastic resin are subjected to electrostatic developing on a photosensitive member, which is an image carrier on which optical information converted from image information is addressed in a digital manner as exposing light, and the toners subjected to developing are electrostatically transferred on a recording medium, which is followed by heating under pressure for forming an image through melt-fixing.

Toners used in the indirect dry electrophotographic method each have a particle diameter in a range of 5 to 12 $\mu$m and it is general to transfer toners in a quantity of 0.3 to 1.2 mg/cm$^2$ for each color. Thermoplastic toners are transferred on the recording medium in a one- to four-layer structure, and while the layered structure is softened and then molted when the layered structure of the toner or toners is subjected to melting by heating, not all of the toner or toners penetrate into a paper sheet but an image is formed on the recording medium each with a height in a range of 5 to 20 $\mu$m.

In FIG. 1, there are shown relations between the input image area percentages of images thus formed on recording mediums vs. the image glossinesses.

FIG. 1 is a result of measurement of 75-degree specular glossiness based on JIS P 8142 on an image, wherein the images were formed with a toner of magenta by a single-lined screen while changing an input image area percentage on a cast coated paper which is a high gloss coated paper (enamel coat, made by Yonago Kako Seishi Co., Ltd), a J coated paper which is a medium gloss coated paper (made by Fuji Xerox Co., Ltd.) and a J paper which is a low gloss coated paper and an uncoated plain paper (made by Fuji Xerox Co., Ltd.). FIG. 2 is a profile of an image thus obtained on the cast coated paper measured by a three-dimensional surface roughness tester in a site where an image area coverage is 40%. As can be seen from FIGS. 1 and 2, while a solid image section assumes a comparatively high gloss, a middle tone area and a highlight area feel uneasy when viewed since each single line or each dot assumes a rise structure, thereby the image in the areas show a recess/protrusion profile on the recording medium, wherein such a profile causes scattering of incident light to the surface to increase and an image which comprises a mixture of high and low gloss areas is, therefore, resulted when the image is an image such as a portrait which has a comparatively wide range of density gradation. Besides, it has been known that such an image with a recess/protrusion profile has a reduced color reproducibility by an influence of irregular reflection on the surface, which is in turn resulted in an image with poor sharpness. When an image with a recess/protrusion profile on the surface is projected by an overhead projector, too, transmitted light is reduced in its color development due to the scattering effect thereof.

In order to improve a color image quality, Japanese Published Unexamined Patent Application No. Sho 63-92965 proposes a method in which a transparent resin layer is formed on a recording medium, a toner is transferred on the medium and the toner is subsequently embedded into the transparent resin layer with a roll heat fixing machine.

In Japanese Published Unexamined Patent Application No. Hei 5-216322 with a similar object to Japanese Published Unexamined Patent Application No. Sho 63-92965, a method is proposed in which a toner is electrostatically transferred on a recording medium on whose surface a transparent resin layer made of thermoplastic resin with 20 to 200 $\mu$m thick is formed and thereafter, the toner is embedded in the transparent resin layer by a belt fixing machine.

According to the method of Japanese Published Unexamined Patent Application No. Sho 63-92965, however, an oily film with a low surface tension is produced between the toner and the transparent thermoplastic resin by an influence of a silicone based oil, which is a release agent, and which is applied on a fixing heat roll, and thereby the toner is not sufficiently embedded in the transparent thermoplastic resin layer to leave a recess/protrusion profile on the surface of the layer. According to Japanese Published Unexamined Patent Application No. Hei 5-216322, the toner is fixed on the recording medium with adoption of the belt fuser, the recording medium is separated from the belt after fixing and cooling, the self cohesive force of the toner can be used as a adhesion preventive force against the belt without a necessity of use of silicone oil as a release agent and a sufficient heating time is obtainable, whereby an image with a recess/protrusion profile is not formed on the surface. However, even if the toner and the transparent thermoplastic resin layer is sufficiently molten by a belt heating and a smooth image surface can be produced, the kinds of toner resin and thermoplastic resin constituting the surface layer disclosed in the publication have insufficient compatibility with each other in the surface layer of the recording medium, which produces a difference in reflective index at an interface in the surface coated layer, thereby causes degradation in color reproducibility and furthermore, leaves some degree of a recess/protrusion profile on the surface. According to the publications of Unexamined Japanese Patent Application Nos. Hei 5-216322 and Sho 63-92965, since transfer of the toner image on the recording medium is electrostatically conducted in either of the publications and the thermoplastic resin provided on the surface of the recording medium has a low dielectric constant, there arise problems that a transfer ratio is especially reduced for a color in the final transfer stage in the case where toners of plural colors are transferred in a multiple-layered structure, which causes not only inhomogeneity of coloring but decrease in color reproduction range.

According to Japanese Published Unexamined Patent Application No. Hei 5-273781, a recording method has been proposed in order to solve the above mentioned faults, in which inorganic oxide fine particles are dispersed in a transparent thermoplastic resin and a recording medium with thus increased dielectric constant is used. However, a paper which is a base has a inhomogeneous texture and therefore it is hard to avoid a disorder in a electric field, when transferring, caused by the electrostatic inhomogeneity of the recording medium, whereby there arise problems that coloring inhomogeneity and degradation in granularity are resulted.

According to U.S. Pat. No. 5,308,733, while there is disclosed a method in which a recording medium having a thermoplastic resin layer including a semi-crystalline polyester layer as the surface is heated in advance of transfer and a toner is transferred by heat, since an image formed is subjected to cracking due to heating of the recording medium prior to the transfer and in addition, because of inclusion of the semi-crystalline layer, there have been cases that embedding of the toner image is poor and glossiness inhomogeneity is thereby produced.

SUMMARY OF THE INVENTION

The present invention has been made in light of the above mentioned problems and it is accordingly an object of the present invention to provide an image forming method, in which an image, whose glossiness is the same as a recording medium regardless of the values of an image density and an image area coverage, and which is especially excellent in not only color reproducibility but graininess, is obtained and in addition, no cracks are produced in the surface layer of the recording medium after the image is formed, and to provide a recording medium preferably used in the method.

An image forming method according to the present invention to achieve an image, whose glossiness is the same as a recording medium regardless of the values of an image density and an image area coverage, and which is excellent in not only color reproducibility but graininess, comprises the steps of: forming a toner image on an image carrier; placing the image formed on the image carrier on a transparent thermoplastic resin layer of a recording medium in a close contact condition, wherein the transparent thermoplastic resin layer is provided on an opaque base of the recording medium at a surface roughness (Ra) of 1.0 $\mu$m or less; and heating the toner image thus placed in the close contact condition to transfer and fix the image on the transparent resin layer.

It is preferable from the viewpoint of effectiveness, herein, that the image carrier is heated to a surface temperature thereof higher than a softening point (Tmt) of a toner before the image carrier reaches a toner image transfer position and the recording medium is separated from the toner image carrier when a temperature of the transparent resin of the surface of the recording medium is lower than a softening point (Tmp) of the transparent resin by 10° C. or more at a position downstream of the toner image transfer position. As an efficient embodiment in this condition, it is preferable that a softening point (Tmp) of the transparent thermoplastic resin provided in the surface of the recording medium is within a difference in a range of +10 to −40° C. of the softening point (Tmt) of the toner and it is more preferable that a surface roughness (Ra) of the opaque base is 0.35 $\mu$m or less.

Besides, if a base with a white pigment layer in the surface is used as the base for the recording medium, an image with more of excellency in color reproducibility can be obtained.

For the purpose not to produce cracks in the surface layer of a recording medium after image forming, a resin material constituting the transparent thermoplastic resin layer preferably includes a structural unit of polyester resin base and further includes polyoxypropylene bis-phenol A and/or glycerin as an alcoholic component of the polyester.

A recording medium of the present invention is a recording medium having a transparent thermoplastic resin layer on at least a surface to record an image of a base thereof, and the base is opaque and has a surface roughness (Ra) of 1.0 $\mu$m or less.

In the recording medium, the base may be made of opaque material and may also be opaque by providing a white pigment layer in the surface. It is preferable that a surface roughness (Ra) of the base is 0.35 $\mu$m or less.

DETAILED DESCRIPTION OF THE INVENTION

Figure 1:
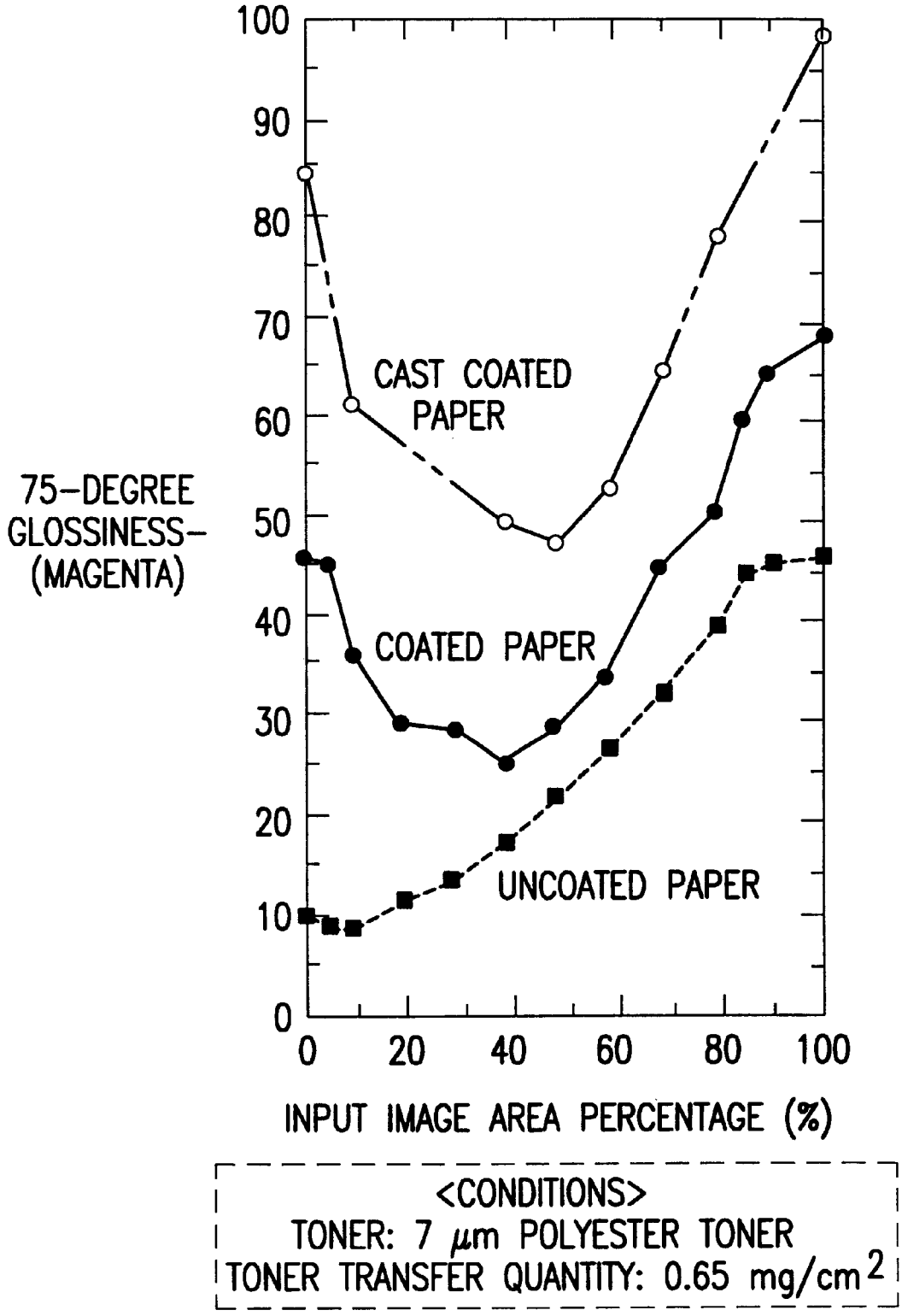
FIG. 1 is a graph showing a result of measurement on 75-degree specular glossiness of images formed while changing an input image area percentage on various kinds of base.
Figure 2:
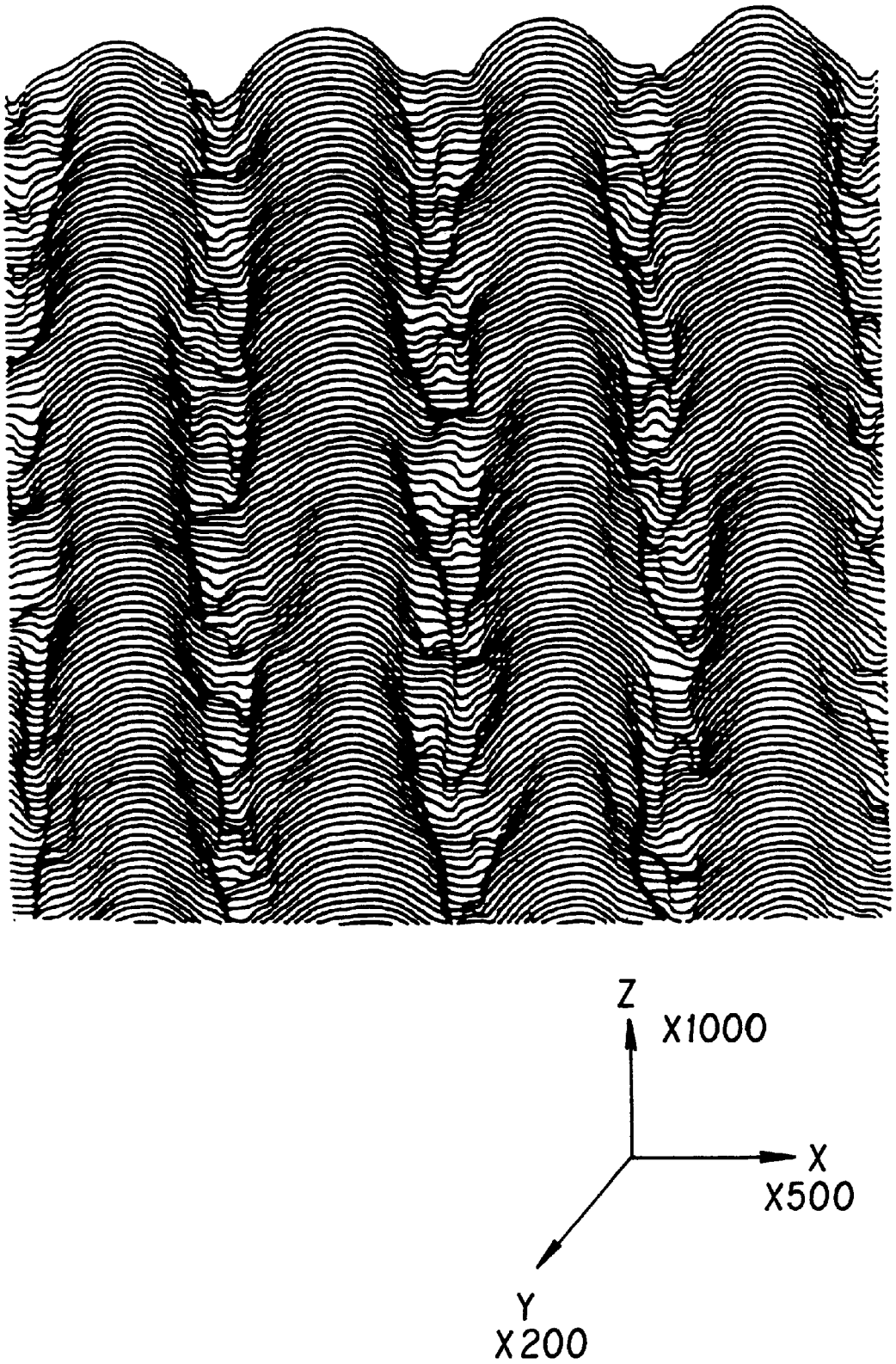
FIG. 2 is a profile of a toner image formed on a cast coated paper measured by a three-dimensional surface roughness tester in a site where an image area percentage is 40%.

Described will be an image forming method of the present invention in a more detailed manner, following the process flow of an electrophotographic method.

In a printer and a copying machine, a digital electrophotographic method has been widely adopted as a method which can provide a high speed and a high image quality. In this method, a light beam which is adjusted to a predetermined spot diameter in an image optical system is used for scanning of a photosensitive member and a latent image in area modulation mode corresponding to an image density signal is formed on the photosensitive member, wherein the area modulation is modulated by an ON/OF time duration of the light beam corresponding to the image density signal determined by pulse duration modulation means. The latent image is visualized by a toner and image forming is thus completed. A process for forming an image in which a toner image is formed is not limited to electrophotography but the process may be a process in which a toner flies directly onto a toner image carrier according to an image data already receiving digital processing and thereby a toner image is formed on the toner image carrier. The image forming process may also be a process in which a magnetic latent image is formed on a toner image carrier according to an image data already receiving digital processing and the toner image is formed according to the magnetic image on the toner image carrier, and the image forming process may also be a process in which an electrostatic latent image is formed by writing a charge image directly on a toner image carrier according to an image data already receiving digital processing and the toner image is thereafter formed on the toner image carrier according to the electrostatic latent image. The toner images thus formed on the toner image carrier are temporarily transferred on an intermediate transfer member and subsequently, the toner image is further transferred on a recording medium for simultaneous transfer/fixing. In that case, the intermediate transfer member corresponds to a toner carrier which is referred to in the present invention. Described will be a method in which a toner image is simultaneously transferred and fixed on a recording medium after the toner image is electrostatically transferred on the intermediate transfer member.

Since the intermediate transfer member is hard to be affected by environmental parameters such as temperature, humidity and the like and thereby its surface conditions as physical properties, resistivity and the like are stable unlike paper which is a common recording medium, electrostatic transfer can be performed in a close contact condition and if proper physical properties are available, there arise almost neither irregularity nor inhomogeneity in a toner image which might be caused by a disorder in a transfer electric field and the like, as mentioned above. Important factors required for an intermediate transfer member in electrostatic transfer are a surface resistivity Rs (Ω) and a volume resistivity Rv (Ωcm) and it is preferable that Rs is in a range of $10^8$<Rs<$10^{16}$ and Rv is in a range of $10^7$<Rv <$10^{15}$. The reason why is that if Rs or Rv is smaller than the lower limit of the corresponding range, an electric charge is widely spread and if, on the other hand, Rs or Rv is larger than the upper limit of the corresponding range, an electric charge is accumulated to an excessively high extent.

A toner image electrostatically transferred to an intermediate transfer member is constructed from dots and single lines which are respectively pixels each of which is a mass of gathered toner particles and an image density is determined by an area percentage of the pixels. The toner image is transferred and fixed on a recording medium in a transfer/fixing section. Accordingly, since no direct multiple electrostatic transfer is conducted on the recording medium, there arises no irregularity in an image and the sharp image with no inhomogeneity in transfer can be obtained on an image carrier, as mentioned above. The toner image is transferred and fixed in the transfer and fixing section.

In the transfer and fixing section, the intermediate transfer member which is an image carrier, the toner image and the recording medium are superposed on one another in one unit and in a close contact condition and heated to form one film while powdery toner is converted into a molten state and thus toner particles are molten to be united. At this time, it is necessary to keep the intermediate transfer member and the recording medium in a close contact condition in order to realize an efficient heat conductance to the toner image and embed the molten toner into the recording medium.

Figure 3A:
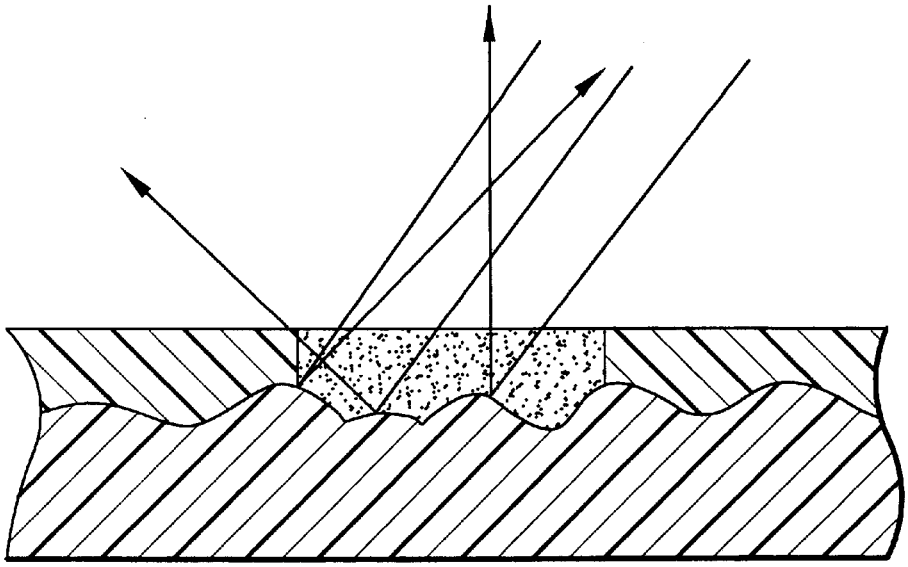
FIG. 3(A) is a conceptual diagram showing a condition in which a toner image is transferred on a recording medium, which comprises a base having a rough surface and a thermoplastic resin layer provided thereon.

In order to embed the molten toner into the recording medium, it is necessity to provide transparent thermoplastic resin in the surface of the recording medium. As a result of serious and aggressive researches conducted by the inventor, it has been found that when the toner is molten and has sunk in the surface layer of the recording medium, development of color largely varies depending on the degree of smoothness of the surface of a base of the recording medium. That is, as shown in a conceptual diagram of FIG. 3(A), even if a thermoplastic resin layer is provided on a rough surface of a base and a toner image is molten and embedded into the resin layer, development of color is reduced in its extent due to scattering of incident light through the resin layer by a recess/protrusion profile on the surface of the opaque base. Moreover, it has been found that since the toner image is formed in conformity with the surface profile of the base, a quantity of coloring material varies from site to site and minor inhomogeneity in image density is eventually observed as poor development of color.

Figure 3B:
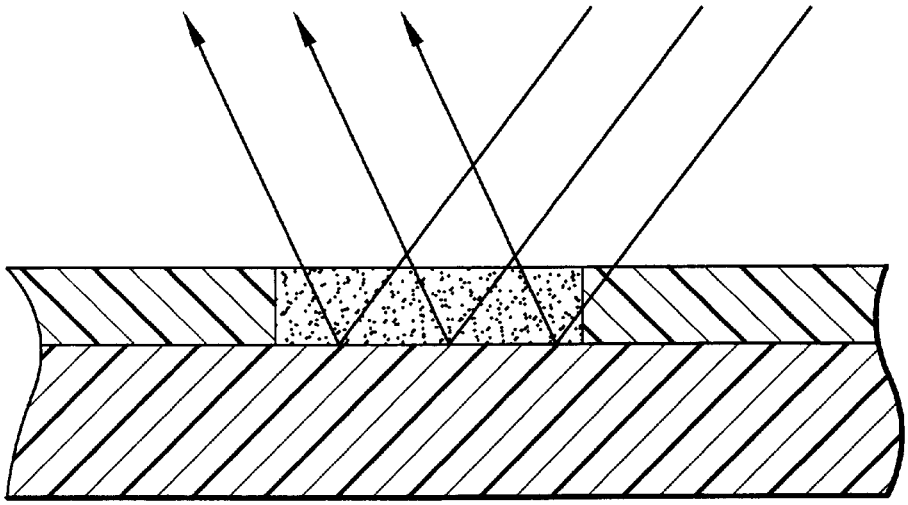
FIG. 3(B) is a conceptual diagram showing a condition in which a toner image is transferred on a recording medium, which comprises a base having a smooth surface and a thermoplastic resin layer provided thereon.

A level of a preferable smoothness of the surface of a base of the present invention is 1.0 μm or less in terms of the center line average height of a surface roughness, measured by a three-dimensional surface roughness tester and should more preferably be 0.35 μm or less. When such a smooth base is used, scattering of incident light does not occur as shown in FIG. 3(B). The reason why is considered that a wavelength of visible light is almost in a range of 380 to 780 nm and therefore, if a surface roughness of the base is larger than a frequency of visible light, an adverse influence of scattering on color development can be so small as to be neglected.

A surface roughness of a base of a recording medium of the present invention was measured by the following method. A three-dimensional surface roughness tester used was a three-dimensional surface roughness tester by the stylus method, SE-30AK Type 4, made by Kosaka Laboratory Ltd. Measuring conditions were a pitch of 2 μm and the number of scans of 500 in an X direction, a pitch of 2 μm and the number of scans of 180 in a Y direction, a measured area of 1×0.36 mm=0.36 $mm^2$, a height (Z direction) gain of 1 and a low range cut-off value of 0.25 mm.

It is preferable that, as a base of a recording medium, if the base on the surface of which a coated layer (hereinafter also referred to as white pigment layer) mainly made of white pigment is provided is used, reflectance of incident light is higher, which preferably improves development of color. There will later be given details of the base of a recording medium.

It is preferable that a softening point of the thermoplastic resin (Tmp) is almost equal to or lower than a softening point (Tmt) of a toner since, since, when a softening point of the thermoplastic resin (Tmp) is almost equal to or lower than a softening point (Tmt) of a toner, thermoplastic resin provided on the surface of a recording medium has a higher effect of embedding toner resin, an adhesive force of the recording medium to an image carrier is larger and a closer contact condition with each other is realized, whereby there does not arise production of micro glossiness inhomogeneity, even if the thermoplastic resin on the surface of the recording medium and the toner are heated to the same temperature. In a definite manner, it is preferable that the thermoplastic resin provided in the surface of the recording medium has a softening point (Tmp) within a difference in a range of +10 to −40° C. of a softening point (Tmt) of a toner. It is more preferable that the thermoplastic resin is a polyester based resin which has a softening point within a difference in a range of ±0 to −20° C. of a softening point (Tmt) of a toner. If a softening point (Tmp) of the thermoplastic resin is higher than a softening point (Tmt) of a toner by more than 10° C., a molten toner is poorly embedded into the transparent resin layer in the surface of the recording medium. If a thermoplastic resin whose softening point (Tmp) is lower than a softening point (Tmt) of a toner by more than 40° C. is used, a molten toner is diffused in the surface layer of the recording medium too much, whereby sharpness of an image is degraded, or a melt viscosity of the surface layer resin of the recording medium is reduced too much, whereby poor separation from an image carrier is easy to occur.

Described will be a preferred recording medium used in an image forming method of the present invention in a detailed manner.

It is preferable that a base of a recording medium of the present invention has a surface roughness (Ra) of 1.0 μm or less and is opaque. As far as the conditions are met, a kind of material of the base may be paper, a synthetic resin film or a metallic thin film, or the surface of the base may be finished with surface processing or may be constructed from a surface layer from an external source provided thereon, in order to improve smoothness of the outermost surface.

In a concrete manner, there can be used acidic or neutral wood free paper, mediocrity paper, ground wood paper, recycled paper, synthetic paper and the like, a surface roughness of which each falls within the above range. If smoothness of such papers is insufficient, it is recommended to provide a white pigment layer on the surface of each paper. It is preferable that a surface roughness is 1.0 μm or less in terms of the center line average height (Ra) measured by a three-dimensional surface roughness tester with the stylus method mentioned above. It is more preferable that a surface roughness is 0.35 μm or less. The reason why is that, as mentioned above, incident light projected into a transparent thermoplastic resin layer develops an image with better color development by reducing an irregularly reflecting component of reflecting light on the white pigment layer.

A kind of pigment used in the papers is not specifically limited but it is properly selected from well known kinds of pigment, for example, calcium carbonates such as heavy calcium carbonate, precipitated calcium carbonate, chalk and the like, silicic acids such as, kaolin, calcined clay, pyrophyllite, sericite, talc, and the like, inorganic pigments such as titanium dioxide and the like, and organic pigments such as urea resin, styrene and the like. A size agent is not specifically limited, either. Sizes such as a rosin based size, a synthetic size, a petroleum resin based size, a neutral size and the like can be used and proper sizes such as aluminum sulfate, cationized starch and the like are used in combination with a fixing agent for fibers. In addition, a reinforcing agent, a dye, a pH regulator and the like may further be added.

When a white pigment layer is provided as the uppermost layer of the base, as white pigments use in the white layer, the following mineral pigments and organic pigments can be used, singly or in combination, but there is no specific limitation to them, which are: mineral pigments such as ground calcium carbonate, precipitated calcium carbonate, titanium dioxide, aluminum hydroxide, satin white, talc, calcium sulfate, barium sulfate, zinc sulfate, magnesium oxide, magnesium carbonate, amorphous silica, colloidal silica, white carbon, kaolin, calcined kaolin, delaminated kaolin, alminosilicate, sericite, bentonite, smectite and the like and organic pigments such as polystyrene resin fineparticles, urea formalin resin fine particles, fine hollow particles and the others.

As a resin to bind a white pigment mentioned above in a white pigment layer, the following materials can be used but there is no specific limitation to them. A water soluble adhesive, emulsion, latex and the like can be used, singly or in combination. For example, there are water soluble resins such as polyvinyl alcohol, modified polyvinyl alcohol, starches, gelatine, casein, methyl cellulose, hydroxyethyl cellulose, acrylic acid amid-acrylic ester copolymer, acrylic acid amide-acrylic acid-methacrylic acid terpolymer, styrene-acrylic resin, isobutylene-maleic anhydride resin, carboxymethyl cellulose and the like; and acrylic based emulsion, vinyl acetate based emulsion, vinylidene chloride emulsion, polyester based emulsion, styrene-butadiene latex, acrylonitrile-butadiene latex and the like.

It is more preferred to finish a coated surface with use of a white pigment and casein mentioned above by a casting method, since the surface is finished to high smoothness. In addition, it is possible to add a trace of a dye or a color organic pigment into a white pigment layer in order to adjust its tone and to add a fluorescent dye in order to improve visual whiteness. Furthermore, the following agents can be added if necessary: a dispersant, an antifoamer, a plasticizer, a pH regulator, a skid, a fluidity modifier, a solidification accelerator, a water proof agent, a size and the like.

As a base other than papers, films made from organic high polymers with a heat resistance 100° C. or higher can be used. They are a polyethylene terephthalate film, a polysulfone film, a polyphenylene oxide film, a polyimide film, a polycarbonate film, a cellulose ester film and the like. These films are transformed to be opaque with coloring materials and the like and can singly used as a base as long as a surface has smoothness in the range mentioned above. In the case of a transparent film or a film which has insufficient smoothness on its surface, it can be used if a white pigment layer is provided as the uppermost layer in a similar way to a paper.

A transparent thermoplastic resin layer is provided as at least one surface of the recording medium which layer is used for the purpose that a molten toner is simultaneously transferred and fixed thereon and further made to penetrate into the surface layer thereof. As transparent thermoplastic resins, the following materials can be used: a styrene and its derivatives or a homo-polymer of a substitution product thereof, and a copolymer, such as styrene, vinyl toluene, α-methyl toluene, chloro-styrene, amino-styrene and the like; methacrylic acid esters, singly or as a copolymer, such as methacrylic acid, methyl methacrylate, ethylmethacrylate and the like; acrylic acid esters, singly or as a copolymer, such as acrylic acid, metylacrylate, butylacrylate, 2-ethylhexylacrylateand the like; dienes, such as butadiene, isoprene and the like; vinyl based monomer, singly or a copolymer with another monomer, such as acrylronitrile, vinyl ethers, maleic acid anhydride, vinyl chloride, vinyl acetate and the like; and polyamide, polyester, polyurethane and the like, singly or in mixture, in which polyester is especially preferred.

A polyester resin can be produced by a reaction between a polyatomic alcohol and a polybasic carboxylic acid. As polyatomic alcohols constituting a polyester, there are named, for example, diols, such as ethylene glycol, diethylene glycol, triethylene glycol, 1,2-propylene glycol, 1,3-propylene glycol, 1,4-butanediol, neopentyl glycol, 1,4-butanediol, cyclohexane dimethanol and the like; glycerin; bis-phenol A alkylene oxide addition products, such as hydrogenated bis-phenol A, polyoxy propylene bis-phenol A and the like; and besides other diatomic alcohols, but there is no specific limitation to them. However, polyoxypropylene bis-phenol A and/or glycerin are especially preferred. It was found by researches conducted the inventors that when polyoxypropylene A bis-phenol A, glycerin or the like is present in the polyester structure of a transparent resin layer of a recording medium, a toner image is very strong against a cracking phenomenon after the image is formed.

As polybasic carboxylic acid, the following can be named but there is no specific limitation to them: maleic acid, fumaric acid, methaconic acid, citraconic acid, itaconic acid, terephthalic acid, isophthalic acid, cyclohexane dicarboxylic acid, succinic acid and anhydrides thereof, alkyl esters and other dibasic acids.

Besides, the following inorganic materials and organic materials, singly or in combination, can be added to these polyesters in order to adjust a surface electric resistivity thereof if a quantity is in a range in which an image quality is deteriorated by the addition: as the inorganic materials, sodium chloride, potassium chloride, calcium chloride, sodium sulfate, zinc oxide, titanium dioxide, tin oxide, aluminum oxide, magnesium oxide and the like, and as the organic materials, alkylphosphoric ester, alkylsulfuric ester, sodium sulfonate, a quaternary ammonium salt and the like. Plastic particles made of styrene or the like can be mixed or various kinds of surfactant can be applied each on the order of such a trace as not to degrade the quality of an image in order to control the friction coefficient of a recording medium or for other purposes.

A thickness of a transparent resin layer, which is made of one of the transparent thermoplastic resins, provided on a base preferably is in a range of 2 to 20 $\mu$m, or more preferably in a range of 4 to 15 $\mu$m. If a thickness is less than the lower limit, molten toner cannot sufficiently be embedded and thereby an image with high rises formed of the toner is resulted. On the other hand, if a thickness is more than the upper limit, an offset phenomenon is easy to arise.

Softening points (Tmp) of the polyester resins are, as mentioned above, selected so as to be within a difference in a range of +10 to −30° C., preferably a range of ±0 to −20° C. of a softening point of a toner in use for image forming.

Described will be parts or members of an image forming apparatus preferably used for an image forming method of the present invention. As an intermediate transfer member, an elastic layer or a resin layer is preferably provided on its surface in order to achieve a close contact condition between the intermediate transfer member and a recording medium, wherein a toner image is sandwiched therebetween. A hardness of the elastic layer is preferably in a range of 5 to 100 in the scale, a thickness of the layer preferably is in a range of 5 to 300 $\mu$m. If the hardness of the elastic layer of the surface of the intermediate transfer medium is less than 5 in the scale, abrasion of the intermediate transfer member surface is fast and easy to lose the glossiness of an image. If the hardness is higher than 100 in the scale, a wrapping effect of an toner image of the surface layer is reduced, which further causes micro-inhomogeneity in glossiness easily. If a thickness of the elastic body is less than 5 $\mu$m, a wrapping effect of an toner image of the surface layer is again reduced, which further causes micro-inhomogeneity in glossiness easily. If a thickness is more than 300 $\mu$m, it is not preferable since electric power for heating up a belt is consumed too much. As a resin layer, it is preferable that resins, such as fluorine containing resin and silicone resin and the like, which show a large releasing effect with a toner, each are used at a thickness in a range of 1 to 200 $\mu$m.

Generally, a transfer/fixing section comprises a heating roll in which a heat source such as a halogen lamp or the like is contained and a pressure roll which pinches and presses an intermediate transfer medium, a toner image and paper against the heating roll, so that the intermediate transfer member, the toner image and the paper are in a close contact condition by pressure from the rolls, a nipping pressure is preferably selected in a range of $1\times10^3$ to $1\times10^6$ Pa. If a nipping pressure is less than the lower limit, the intermediate transfer member, the toner image and the recording medium are not brought into a sufficient close contact condition and a molten toner does not sufficiently penetrate into the recording medium, whereby micro-inhomogeneity in glossiness occurs easily. If a nipping pressure is larger than the upper limit, a stress in each of the intermediate transfer member and the recording medium is built up to produce wrinkles on the image surface and there arises a further obstacle that a mechanism which supports a high pressure increases complexity in the apparatus. As replacement of the heating roll, a stationary heat generating member can be used, which is constructed from a heat resistant support, a resistance heater provided thereon and the uppermost layer made of a heat resistant and abrasion resistant film covering the heater.

Figure 4:
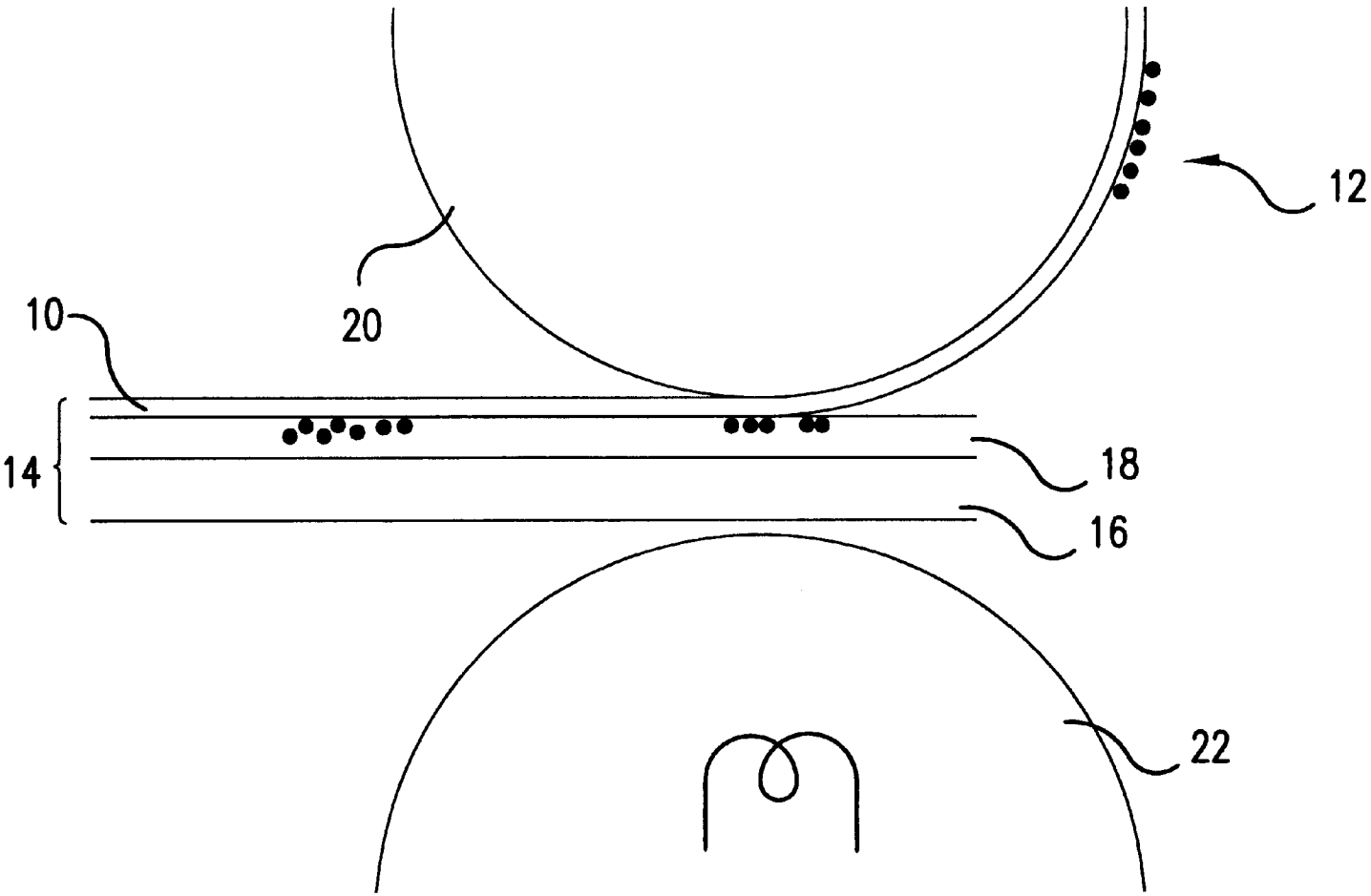
FIG. 4 is a view, as a model, showing the behavior of a toner image at a transfer/fixing position for an toner image in an image forming method of the present invention.

FIG. 4 is a view, as a model, showing behavior of a toner image at a transfer and fixing position for an toner image in an image forming method of the present invention. As shown in FIG. 4, in the case where an toner image 12 formed on the surface of an image carrier 10 is not in advance heated at an upstream position thereof, even if a softening point of a surface resin layer 18 of the recording medium is equal to or lower than a softening point of a toner, there is a chance where a viscosity of the surface resin layer 18 of the recording medium is apt to be decreased before a viscosity of a molten toner is decreased in a region where three portions comprising the recording medium 14, the toner image 12 and the image carrier 10 are in a close contact condition, and the toner sinks into the surface resin layer 18 while holding its elasticity, whereby the toner forms a low rise or is kept in a condition that the toner is insufficiently molten in the surface resin layer 18 after a force to produce a close contact condition is removed. For this reason, there can arise a result that colors are insufficiently developed or glossiness of the toner image is degraded. However, if there is allowed a sufficiently long time to elapse during which the three portions comprising the recording medium 14, the toner image 12, and the image carrier 10 reside in the region where the three portions are in a close contact condition or a heating temperature is set higher, in order to control a transfer/fixing condition, there arises no problem in developing colors. Therefore, it is recommended to control in such a manner.

The inventors heated the surface of the image carrier 10 which contacts with the toner image 12 in an upstream region of the transfer/fixing position to preheat the toner image 12 on the image carrier 10 and found that it was able to obtain an excellently transferred image without any complicated adjustments on the transfer/fixing conditions with such preheating and a preheating temperature was preferably set at a temperature equal to or higher than a softening point (Tmt) of the toner.

Figure 5:
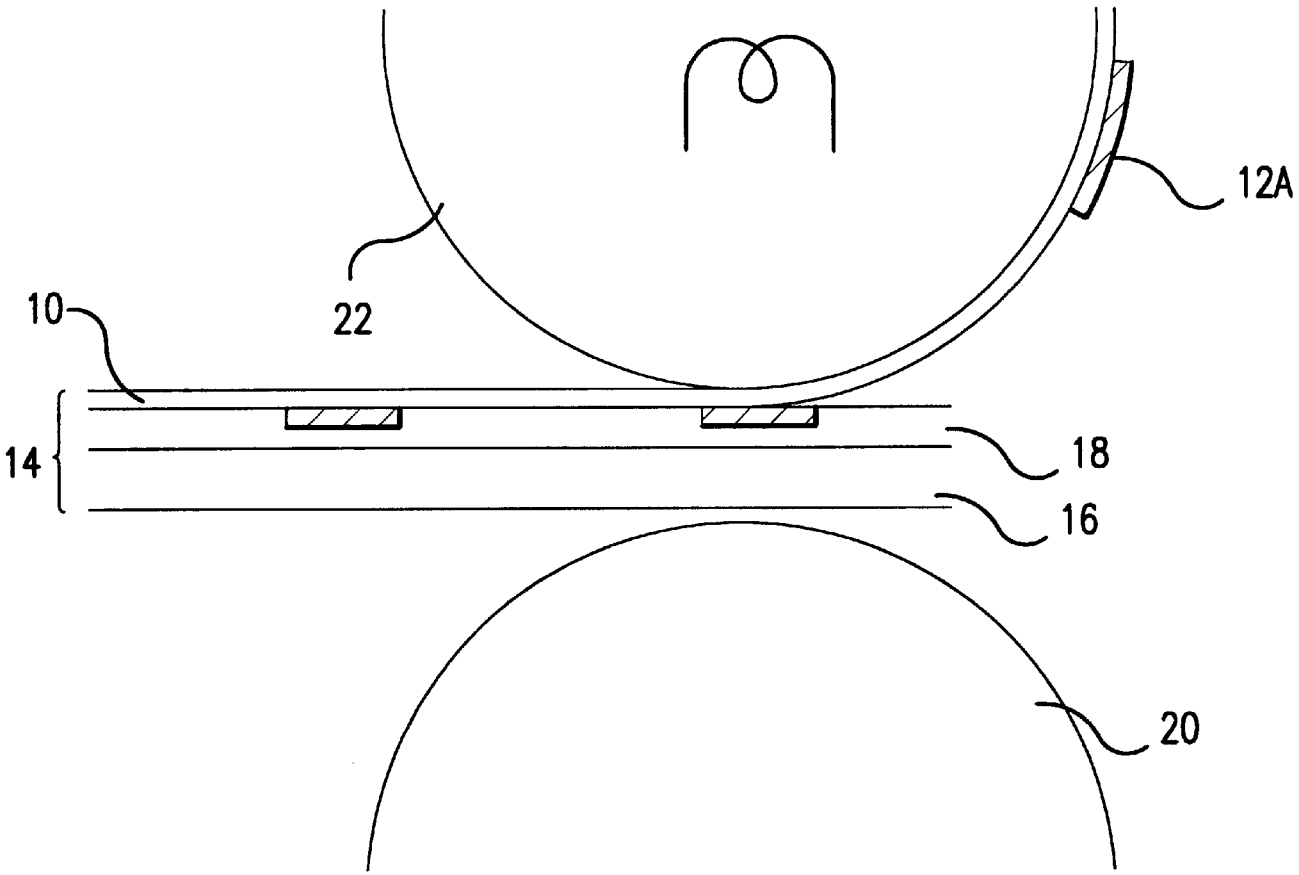
FIG. 5 is a view, as a model, showing the behavior of a toner image at a transfer/fixing position when a preferred preheating of the toner image is conducted in an image forming method of the present invention.

FIG. 5 is a view, as a model, showing behavior of a toner image at a transfer/fixing position when the preferred preheating of a toner image is conducted in an image forming method of the present invention. As shown in FIG. 5, it is preferable that a toner image 12 located on the surface of an intermediate transfer member 10 is heated to a toner image 12A in a molten condition by heating the toner image 12 to a temperature in the vicinity of a softening point (Tmt) of the toner in advance at a position upstream where three portions of the intermediate transfer member 10, the toner image 12 and the recording medium 14 are heated in a close contact condition wherein the intermediate transfer member 10 serves as an image carrier. That is, the toner prepared in advance so as to have a low viscosity enters a nipping region where the three portions are in a close condition.

At this point, the toner image 12A is heated and transferred on a transparent resin layer 18 of the surface of the recording medium 14 by a pressure roll 20 and a heating roll 22, wherein since the toner with a low viscosity which is in advance prepared enters the nipping region where the three portions are to be nipped to a close contact condition, not only is the surface resin layer 18 of the recording medium molten but the toner image 12A already in a molten condition can also be sunk into the surface layer and since a storage modulus of the toner is also reduced, an image portion is not raised out of the surface resin layer of the recording medium after a force to produce a close contact condition is removed and at the same time the toner does not remain insufficiently molten in the surface resin layer of the recording medium, whereby the image excellent in glossiness and color development can be obtained.

Means for heating an intermediate transfer member and a toner image in advance may be of a contact type or of a non-contact type as far as a temperature control including an on/off control is possible and there can be used a heating lamp or a heating roll containing a heat source therein and the like which are provided separately from a stationary heat generating member, but there is no specific limitation to them.

Figure 6:
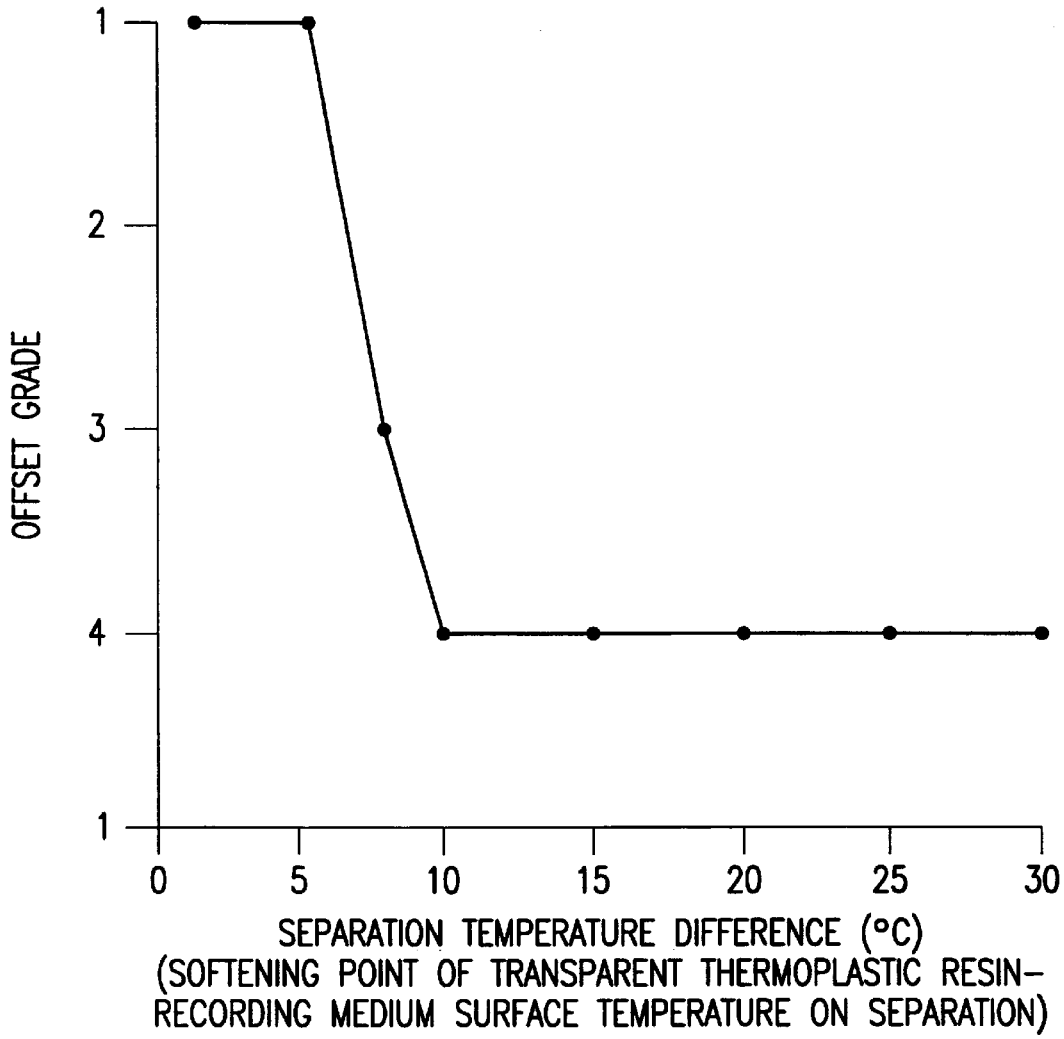
FIG. 6 is a graph showing a relation of the temperature difference between a softening point of a transparent resin and a recording medium at a separating position vs. the offset grade of the surface of the recording medium after separation.

When separation between the recording medium, and the intermediate transfer member, which is an image carrier, and the toner is conducted, a surface temperature of the recording medium at an interface between the recording medium and the image carrier is preferably set at a temperature lower than a softening point (Tmp) of the transparent resin provided in the surface of the recording medium by 10° C. or more. As shown in FIG. 6, when the surface temperature of the recording medium on separation is a lower temperature with a difference less than 10° C. as compared to a softening point (Tmp) of the transparent resin provided in the surface of the recording medium, since the transparent resin layer provided in the surface of the recording medium does not have a sufficient cohesive force, the transparent resin of the recording medium surface is transferred on the image carrier on separation or there is caused an offset phenomenon that a roughened surface condition appears on the recording medium surface, whereby glossiness on the surface has a chance to be reduced.

The offset grade is evaluated according to the following criteria, that is:

1: severe separation of a transparent resin layer

2: roughened surface of a recording medium

3: slightly roughening of a recording medium surface

4: no problem

A measuring method of a surface temperature of a recording medium comprises the steps of: setting a thermocouple on the recording medium surface in advance; a toner and an image carrier are transferred/fixed; and subsequently, a temperature is monitored till the recording medium gets separated from the image carrier.

A softening temperature (Tmt) of a toner and a softening temperature (Tmp) of a transparent resin provided in the surface of a recording medium which have been mentioned are defined as follows: a flow tester CFT 50° C. made by Shimadzu Corp. is used and an equi-speed temperature rise is applied to a specimen in conditions of a initial temperature of 80° C., the maximal temperature of 170° C., a temperature raise speed of 3° C./min, a preheat time of 300 sec, a cylinder pressure of 10 kgf/cm$^2$ and die L×D=1.0 mm×1.0 mm, wherein a toner and a transparent resin provided in a recording medium, which are specimen each in a fine powder form, are respectively weighed each at a weight in a range of 1 to 3 g in a precise manner and a plunger sectional area is set at 10 cm$^2$. As the specimen, for example the toner, goes along the course of the equi-speed temperature rise, the toner is gradually heated and begins to flow out. When the toner is further heated up, the toner already in a molten condition flows out extensively, which causes shift-down of the plunger to stop, and the process is terminated. Flow rates are measured at temperatures with intervals of 3° C. from 60 to 150° C. to attain an apparent viscosity $\eta'$ (Pa·s). At this point, a temperature at which an apparent viscosity $\eta'$(Pa·s) assumes $1\times10^4$ Pa·s is defined as a softening point of the toner or the transparent resin provided in the recording medium surface.

Figure 7:
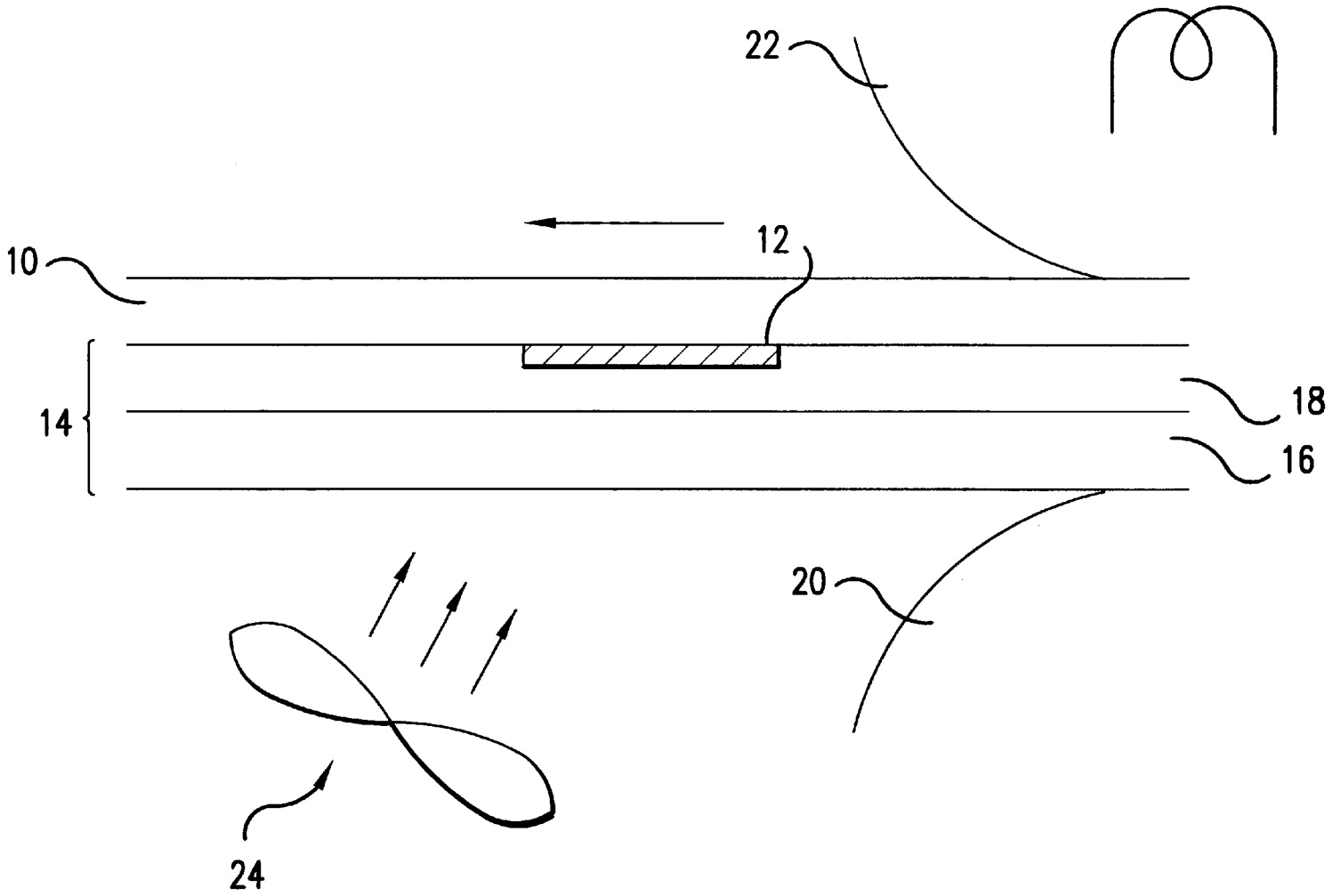
FIG. 7 is a schematic view showing a cooling condition of an intermediate transfer member, a toner image and a recording medium, which are all transported mutually in a close contact condition, by a cooling fan disposed in a position downstream of a transfer/fixing position.

While means for lowering a temperature of a recording medium surface are not always required, by employing one of cooling methods, in which cold air is blown to the intermediate transfer member 10 and the recording medium 14 by a cooling fan 24, which is disposed at a down stream position of a transfer/fixing position, wherein the intermediate transfer member 10, a toner image 12 and the recording medium 14 are transported mutually in a close contact condition as shown in FIG. 7, and by another method in which a low temperature member of the order of room temperature is made to contact the intermediate transfer member or the recording medium as cooling means, the heat can be transferred from a high temperature portion to a low temperature portion to achieve the above mentioned effect. In this case, if cooling means to contact assuming the form of a belt is moved in circulation, part of the belt is heated, the heated part can be made to contact with the intermediate transfer member or paper at the exit of the nipping section under pressure, and the belt is cooled at another position different from the contacting position, whereby the effect can be attained in a continuous manner. This can be achieved if a different position from a position at the exit of the nipping section under pressure where contact with the intermediate transfer medium or paper occurs is selected for heat exchange with another low temperature body, for example, contact with the intermediate transfer member of a low temperature before entering a heating region. Moreover, as a cooling device at the exit of the heating region, a heat exchanger such as a heat pipe may be used for heat transfer.

The cooling means at the exit of the nipping section under heat/pressure is disposed either on the heater side or the pressuring body side, or both of them in an effective manner, but if the cooling means is disposed on the pressuring body side which is kept at a comparatively low temperature, a temperature rise of the cooling means is suppressed and heat deprived of the heater can be reduced, which leads to transfer/fixing with good thermal efficiency.

As a binder resin for a toner used in a method of the present invention, well-known resins can be used. For example, the following materials can be used: a styrene and its derivatives or a homo-polymer of a substitution product thereof, and a copolymer, such as styrene, vinyl toluene, α-methyl toluene, chloro-styrene, amino-styrene and the like; methacrylic acid esters, singly or as a copolymer, such as methacrylic acid, methyl methacrylate, ethylmethacrylate and the like; acrylic acid esters, singly or as a copolymer, such as acrylic acid, metylacrylate, butylacrylate, 2-ethylhexylacrylate and the like; dienes, such as butadiene, isoprene and the like; vinyl based monomers, singly or a copolymer with another monomer, such as acrylronitrile, vinyl ethers, maleic acid anhydride, vinyl chloride, vinyl acetate and the like; and polyamide, polyester, polyurethane and the like, singly or in mixture, in which polyester is especially preferred.

A polyester resin can be produced by a reaction between a polyatomic alcohol and a polybasic carboxylic acid. As polyatomic alcohols constituting a polyester, there are named, for example, diols, such as ethylene glycol, diethylene glycol, triethylene glycol, 1,2-propylene glycol, 1,3-propylene glycol, 1,4-butanediol, neopentyl glycol, 1,4-butanediol, cyclohexane dimethanol and the like; bis-phenol A alkylene oxide addition products, such as hydrogenated bis-phenol A, polyoxy propylene bis-phenol A and the like; and besides other diatomic alcohols.

As polybasic carboxylic acid, the following can be named but there is no specific limitation to them: maleic acid, fumaric acid, methaconic acid, citraconic acid, itaconic acid, terephthalic acid, isophthalic acid, cyclohexane dicarboxylic acid, succinic acid and anhydrides thereof, alkyl esters, other dibasic carboxylic acids.

As coloring materials to be mixed into a toner binding resin, well-known pigments and dyes can be used. An additive agent externally used, which has conventionally known for the purpose such as charge control, can be used.

What is important in an image forming method of the present invention is surface smoothness of an opaque base used for a recording medium and temperature conditions inatransfer/fixingprocess for a toner image and a separation process for separation between an image carrier and the recording medium. Therefore, an image forming apparatus preferably used in a image forming method comprises: an image carrier for carrying a toner image; transfer/fixing means for transferring and fixing the toner image formed on the image carrier onto a transparent thermoplastic resin layer provided on a base of a recording medium, wherein the toner image formed on the image carrier is heated at a temperature equal to or higher than a softening point (Tmt) of a toner constituting the toner image and the image carrier for carrying an toner image is disposed in a close contact condition with the transparent thermoplastic resin layer which is provided in the surface of the recording medium; and separating means for separating the recording medium from the toner image carrier at a time when a temperature of the transparent resin layer of the surface of the recording medium reaches a temperature lower than a softening point (Tmp) of the transparent resin by 10° C. or more.

As mentioned in detail, according to the present invention, it is possible to embed a toner image in a transparent resin layer of a recording medium without any irregularity in image, to obtain homogeneous glossiness over all the area percentage region, and especially to attain a color image with not only good color development but good granularity and moreover without any generation of cracks.

EXAMPLES

Below further described will be the present invention using examples and, however, it should be understood that the present invention is not limited to the examples.

(Recording Medium)

As a base, a raw paper with a thickness of 90 g/m$^2$ was subjected to a super calendar process, subsequently was applied with a coating material composed of a white pigment and an adhesive in a compounding ratio of 87 parts to 13 parts, wherein the adhesive was composed of styrene butadiene rubber (SBR) and polyvinyl alcohol (PVA) in a compounding ratio of 69 parts and 31 parts, and the white pigment was composed of kaolin and calcium in a compounding ratio of 71 parts and 29 parts, to a coating thickness of 20 g/m$^2$ on a felt side and 20 g/m$^2$ on a wire side both after drying by a labocoater and then the coated paper was further subjected to a super-calendar process to obtain a base K1. The base K1 was measured by the three-dimensional surface roughness tester mentioned above and a result was a center line average height (Ra) surface roughness of 0.3 $\mu$m.

Supercalendaring applied to the base material body K1 was weakened to obtain a base K2 of a center line average height (Ra) surface roughness of 1.0 $\mu$m. In addition, calcium carbonate powder of larger particle sizes was used to obtain a base K3 of a center line average height (Ra) surface roughness of 1.8 $\mu$m.

Three kinds of polyesters having properties shown Table 1 described below (PE1, PE2, PE3) were prepared on each surface of the three kinds of bases K1, K2, K3, and three kinds of polyester solutions were prepared by stirring the respective polyesters in ethyl acetate for dissolution in mixing ratios of 20 parts by weight of the respective polyesters to a common 80 parts by weight of ethyl acetate. The polyester solutions of the three kinds were applied on enamel papers by use of a mayor bar to a coat and each coat was sufficiently dried to obtain a transparent resin layer of a thickness of 10 $\mu$m. Recording media thus obtained are respectively indicated by P1, P2, P3, P4, P5, P6, P7, P8 and P9 and properties and parameters thereof are shown in Table 1. Images were formed by use of these recording media and toners shown next in an image forming apparatus.

TABLE 1

| Recording media | Bases | Surface roughnesses (Ra, $\mu$m) | Polyesters | Monomers constituting thermoplastic polyesters | Tmp (° C.) |
|---|---|---|---|---|---|
| P1 | K1 | 0.3 | PE1 | BPA-EO, FMA | 89 |
| P2 | K1 | 0.3 | PE2 | BPA-EO, BPA-PO, TPA, glycerin | 100 |
| P3 | K1 | 0.3 | PE3 | BPA-EO, BPA-PO, succinic acid derivative, TPA, TMA | 131 |
| P4 | K2 | 1.0 | PE1 | BPA-EO, FMA | 89 |
| P5 | K2 | 1.0 | PE2 | BPA-EO, BPA-PO, TPA, glycerin | 100 |
| P6 | K2 | 1.0 | PE3 | BPA-EO, BPA-PO, succinic acid derivative, TPA, TMA | 131 |
| P7 | K3 | 1.8 | PE1 | BPA-EO, FMA, | 89 |
| P8 | K3 | 1.8 | PE2 | BPA-EO, BPA-PO, TPA, glycerin | 100 |
| P9 | K3 | 1.8 | PE3 | BPA-EO, BPA-EO, succinic acid derivative, TPA, TMA | 131 |

BPA-EO: polyoxyethylene(2,2)-2,2-bis(4-hydroxyphenyl)propane
BPA-PO: polyoxypropylene(2,2)-2,2-bis(4-hydroxyphenyl)propane
TPA: terephthalic acid
FMA: fumaric acid
DSA: dodecenyl succinic acid
TMA: trimellitic acid anhydride (Toner)

A producing method for a toner will be described. A polyatomic alcohol and a polybasic acid in raw material composition shown in Table 2 were put in a four-neck, round-bottom flask with one liter capacity equipped with a stainless stirrer, a glass nitrogen gas inlet tube and a reflux condenser and the flask was set in a mantle heater. Then nitrogen gas is introduced through the gas inlet tube and a temperature in the flask was raised under an inert gas atmosphere. Thereafter, 0.05 parts of dibutyl tin oxide was added and a reaction was effected while a temperature of reactants was kept at 200° C. for a specific period to obtain a polyester resin to be used for a toner. Six parts by wt of an yellow pigment, 4.5 parts by wt of magenta pigment and 4.5 parts by wt of cyan pigment and 4 parts by wt of carbon black were added to 100 parts by wt of thus obtained polyester resins to form mixtures and the mixtures were molten by an extruder, kneaded and thereafter cooled. After the cooling, the mixtures were pulverized by a jet mill and the powders were sieved to classify into respective toners of yellow, magenta, cyan and black in color, each having a volume average diameter of 7 $\mu$m.

TABLE 2

| Toner binder | |
|---|---|
| Constituting monomer | Tmp (° C.) |
| BPA-EO, BPA-PO, succinic acid derivative, TPA, TMA | 120 |

(Image forming Apparatus 1)

Figure 8:
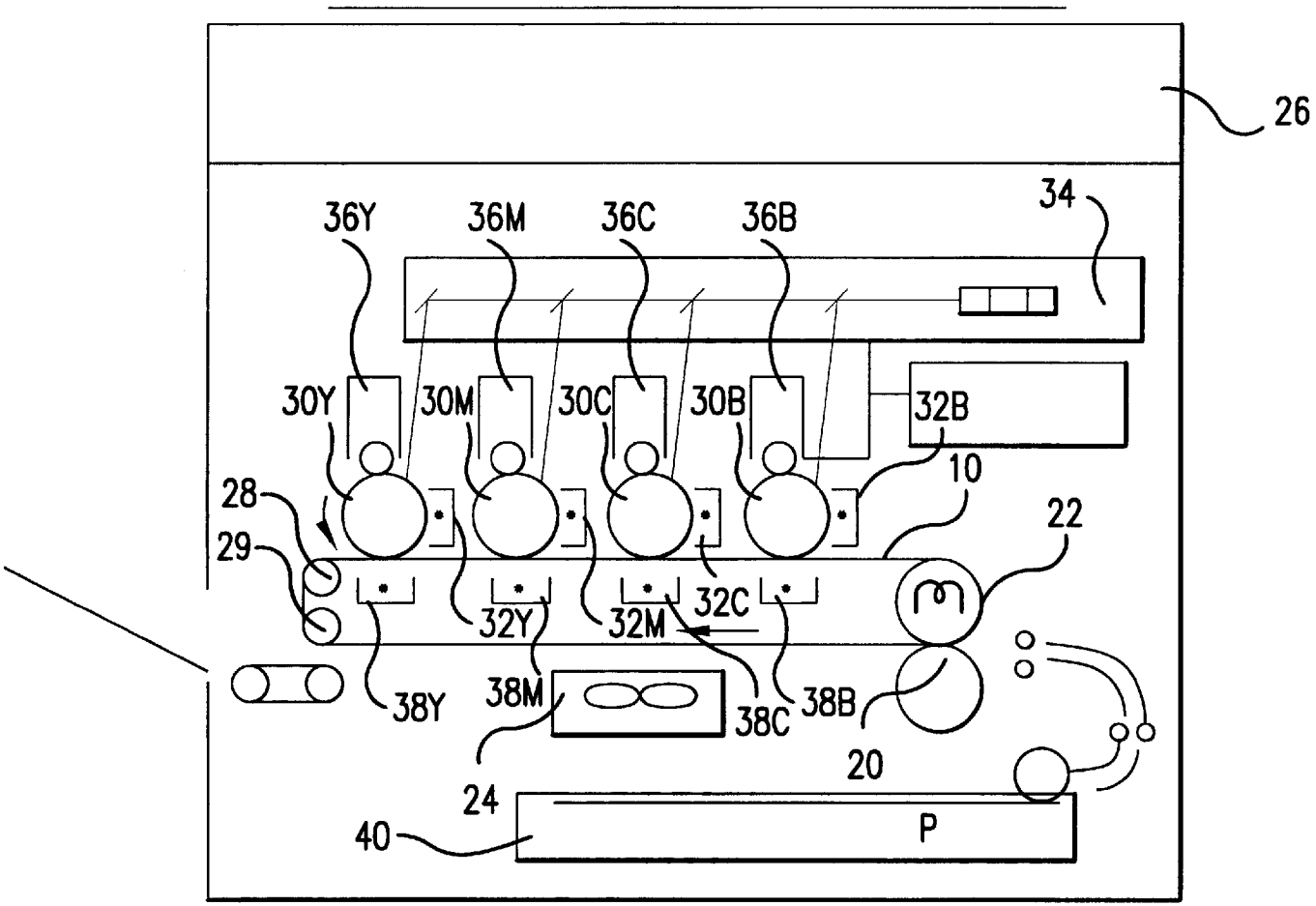
FIG. 8 is a structural view of an image forming apparatus 1 used in the embodiments.

FIG. 8 is a conceptual view showing a structure of an image forming apparatus 26 used in an image forming method of the present invention. In the image forming apparatus 26, a belt-type intermediate transfer member 10 travels along in a direction of an arrow shown in the figure while being supported by rolls 28, 29 and a heating roll 22. At a transfer/fixing position, there are disposed a pressure roll 20 opposed to the heating roll. The heating roll 22 and the pressure roll 20 can be disposed in a reverse way and the pressure roll 20 may also be used as a heating roll which contains a heat source inside.

In the neighborhood of the intermediate transfer member 10, there are disposed 4 photosensitive members 30Y, 30M, 30C and 30B respectively corresponding to yellow, magenta, cyan and black, those members are respectively charged by chargers 32Y, 32M, 32C and 32B in a uniform manner and further exposed to a light beam from a light beam scanner 34 regulated in an on/off manner modulated by a light beam pulse duration modulator according to a density signal to make an electrostatic latent image. Electrostatic latent images on the respective photosensitive members are respectively developed by developing devices 36Y, 36M, 36C and 36B in which toners of yellow, magenta, cyan and black in color are respectively contained and so-called digital images of the colors, whose densities are subjected to area modulation, are formed on the respective photosensitive members 30Y, 30M, 30C and 30B. The respective toner images are successively transferred on the intermediate transfer member 10 by transfer devices 38Y, 38M, 38C and 38B to make a toner image of plural colors thereon.

The pressure roll 20 gives pressure against the heating roll 22 on feed of the recording medium P from a tray 40. Thereafter, the intermediate transfer member 10 carrying the images of plural colors and the recording medium P move through between the heating and pressure rolls 22, 20 to be pressed and heated in controlled timing. Toners heated at a temperature equal to or higher than a melting point are softened, molten, then penetrate into the recording medium P. The molten toners in the recording medium P are then solidified to complete a transfer/fixing process.

A cooling device 24 disposed at a downstream position of the transfer/fixing position is used for cooling the intermediate transfer member 10 and the recording medium P which are transported in one unit from the heating region and thereby the toner coagulates and is solidified, which produces a strong adhesive force to the recording medium P, and which is also followed by solidification of a transparent resin of the recording medium P. The intermediate transfer member 10 and the recording medium P cooled by a cooling device 24 are transported and the recording medium P is separated from the intermediate transfer member 10 together with the toner thereon by cooperation of its bending rigidity and a small radius of curvature of the roll 29 to make a color image on the recording medium P. The surfaces of the transferred/fixed toner image on the recording medium P and the recording medium are made smooth by the surface of the intermediate transfer member 10, with which the recording medium P is in a close contact condition during transportation and thereby an image with a uniform surface and a high glossiness on the surface can be formed.

Well known photosensitive members 30Y, 30M, 30C and 30B can be used in an image forming apparatus used in a method of the present invention. For example, various kinds of inorganic photosensitive members (Se, a-Si, a-SiC, CdS and the like) and in addition various organic photosensitive members and the like can be used.

Toners respectively comprises thermoplastic binders including colors such as yellow, magenta, cyan and the like and well-known materials can be used. In the examples, polyester shown in Table 2 was used in order to conduct image forming by the photosensitive members 30Y, 30M, 30C and 30B. The toner had a weight average molecular weight (Mw) of 54000, a softening point (Tmt) of 120° C. The toner having an average particle diameter of 7 $\mu$m was used. Conditions for developing and exposure for the respective colors are set so that quantities of the coloring materials are in an range of 0.4 mg/cm$^2$ to 0.7 mg/cm$^2$according to respective contents in the toners of various colors. In the examples, the respective quantities of coloring materials were set to 0.65 mg/cm$^2$ in common.

A diameter of a light beam used by the light beam scanning device 20 was 20 $\mu$m so that an image with a high contrast was obtained.

An intermediate transfer member 50 having a two-layer structure comprising a base layer and a surface layer was used.

As the base layer, a polyimide film added with carbon black having a thickness of 70 $\mu$m was used. In the example, a volume resistivity of the base layer is adjusted to be $10^{10}$ Ωcm by varying an additive quantity of carbon black in order to electrostatically transfer an toner image on an intermediate transfer member from a photosensitive member without any irregularity of the image. As the base layer, it is possible to use, for example, a high heat resistant sheet with a thickness of 10 to 300 $\mu$m can be used. Polymer sheets made of polyester, polyethylene terephthalate, polyether sulfone, polyether ketone, polysulfone, polyimide, polyimideamide, polyamide and the like can be used.

A volume resistivity of the surface layer was adjusted to $10^{14}$ Ωcm in order to electrostatically transfer a toner image on the intermediate transfer member from a photosensitive member without any irregularity of the image, and a silicone copolymer with a rubber hardness of 40 in the scale and a thickness of 50 $\mu$m was used as the surface layer in order to increase the degree of closeness between the intermediate transfer member and paper, wherein the toner image was sandwiched therebetween. Silicone copolymer is most preferable as the surface layer, since silicon copolymer has elasticity, and the surface thereof shows a pressure sensitive adhesiveness to the toner at room temperature and has a characteristic that it is molten, flown and thereby facilitates a toner to be released from itself in order to efficiently transfer the toner on the recording medium. As for the surface layer, for example, there can be used a resin layer having a thickness of 1 to 100 μm with high releasability and there can be used as such resins, for example tetrafluoroethylene-perfluoroalkylvinylether copolymer, polytetrafluoroethylene and the like.

A metal roll or a metal roll on which a heat resistant elastic layer such as a layer made of silicone rubber can be used as the heating and pressure rolls. A heat source was provided inside the heat roll and a heating temperature thereof is set and controlled so that the intermediate transfer member assumes a temperature equal to or higher than a toner softening point (Tmt) at an upstream position of the transfer/fixing position. A heating region was set in such conditions that the photosensitivity member 1, the toner image and the recording paper P mutually assumed a sufficiently close contact condition therein without any local lift of the image and, furthermore, with no wrinkles and dislocation in the recording medium P. The nipping pressure was preferably in a range of $1\times10^3$ to $1\times10^6$ Pa. In the example, as heating and pressure rolls, used were hollow aluminum rolls each with a 3-mm-thick silicon rubber layer thereon and as a heat source inside the heating roll, a halogen lamp was used. The nipping pressure was set to $5.0\times10^5$ Pa.

In the examples, an air flow rate of the cooling device 24 was adjusted so that a temperature of the recording medium surface contacting with the intermediate transfer member might be 70° C. when the recording medium was separated from the intermediate transfer member.

A single-lined screen with 200 lines per inch was used.

In the above structure, the intermediate transfer member and the toner image were transported at a speed of 160 mm/s and test specimens obtained were subjected to evaluations on image glossiness, color reproduction, graininess and cracking on the surfaces of toner images and recording mediums.

The evaluations on image glossiness, color reproduction, graininess and cracking of the surfaces of toner images and recording mediums were conducted in the following manner: 2×2 $cm^2$ patches respectively with Y (yellow), M (magenta), C (cyan), K (black), R (red), G (green), B (blue) and PB (threecolorblack) wereoutput at intervals of 10% over a range of 0 to 100% in input image area percentage and the patches were visually examined. Image glossiness was evaluated by measuring 75-degree specular glossiness.

(Image forming Apparatus 2)

Figure 9:
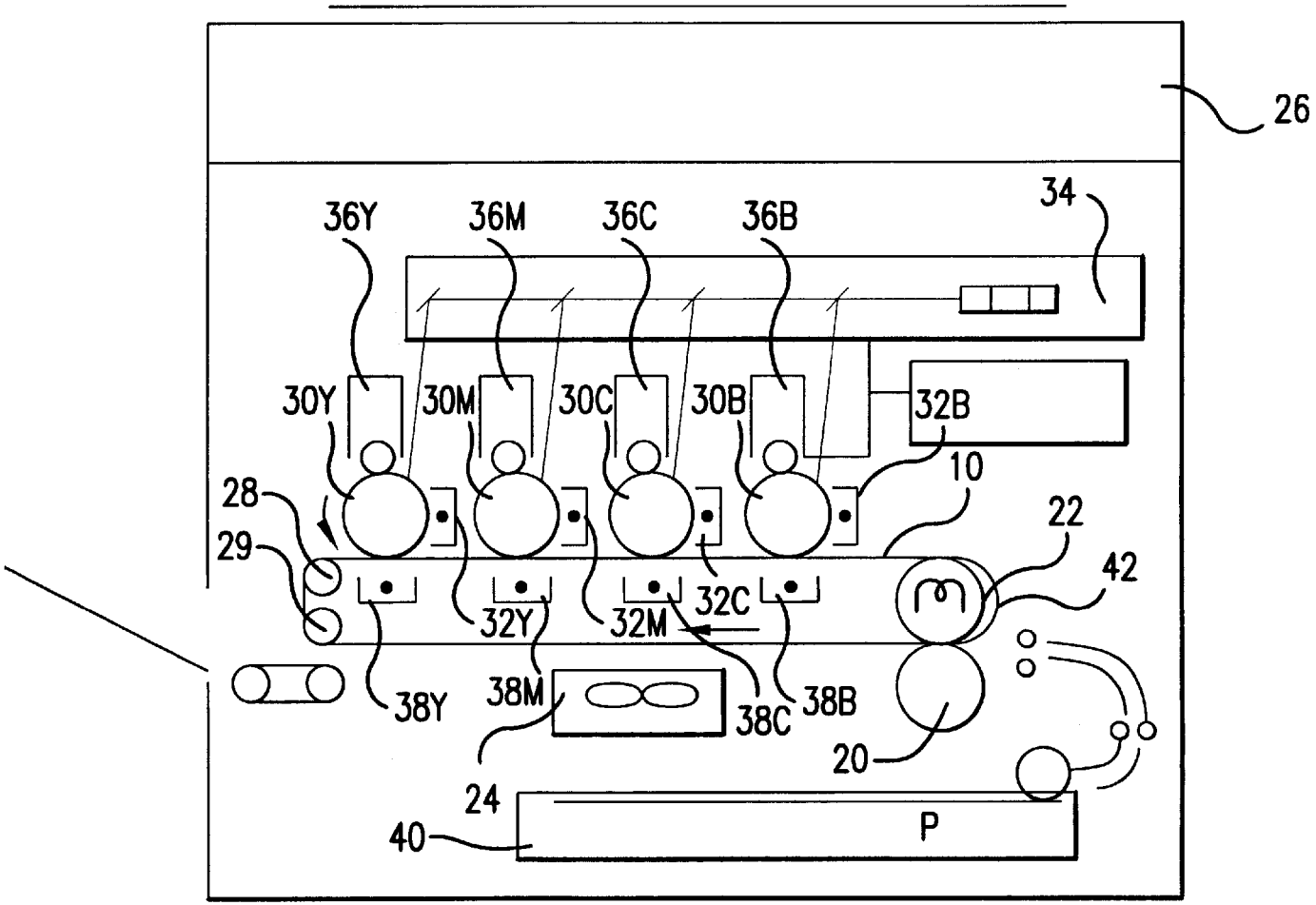
FIG. 9 is a structural view of an image forming apparatus 2 used in the embodiments.

As shown in FIG. 9, images were formed by the recording method 1 using the image forming apparatus 1 with the exception that a heating plate 42 made of aluminum having a curvature was disposed outside a heating roll 20 and an intermediate transfer member was run over along the outer periphery of the heating plate 42, wherein the heating plate 42 was set and controlled at a temperature higher than a toner softening point (Tmt) by 40° C. FIG. 9 is a structural view showing an image forming apparatus 44 using the image forming method of the examples.

(Examples 1 to 6, Comparative Examples 1 to 3)

The above mentioned image forming apparatuses 1 and 2 were used and images were obtained from combinations of recording media P1 to P9 and toners for evaluation.

Results are shown in Table 3, wherein the evaluation was made according to the following criteria:

A: especially good

B: good

C: acceptable level

D: bad (not acceptable)

TABLE 3

| Examples Comparative examples | Recording apparatuses | Recording media | surface roughnesses of bases (Ra, μm) | Tmp-Tmt (° C.) | Color uniformity | color reproduction | cracking | Graininess | overall evaluation |
|---|---|---|---|---|---|---|---|---|---|
| Embodiment 1 | 1&2 | P1 | 0.3 | −31 | A | A | C | B | B |
| Embodiment 2 | 1&2 | P2 | 0.3 | −20 | A | A | A | B | B |
| Embodiment 3 | 1&2 | P3 | 0.3 | +11 | C | B | B | C | C |
| Embodiment 4 | 1&2 | P4 | 1.0 | −31 | B | B | C | B | B |
| Embodiment 5 | 1&2 | P5 | 1.0 | −20 | B | B | A | B | B |
| Embodiment 6 | 1&2 | P6 | 1.0 | +11 | C | C | B | C | C |
| Comparative example 1 | 1&2 | P7 | 1.8 | −31 | B | D | C | B | D |
| Comparative example 2 | 1&2 | P8 | 1.8 | −20 | B | D | A | B | D |
| Comparative example 3 | 1&2 | P9 | 1.8 | +11 | C | D | B | C | D |

As can be seen from the results in the table, when images are formed by transferring and fixing toners already in a molten condition on recording media whose bases each have a surface roughness of a center line average height (Ra) of 1.0 μm or less, clear images excellent in color development can be obtained both in the recording method 1 using the image forming apparatus 1 and the recording method 2 using the image forming apparatus 2.

Images formed on recording media, on whose surface was provided polyester resin, which was thermoplastic resin, having a softening point (Tmp) within a difference in a range of +10 to −30° C. of a toner softening point (Tmt) all showed the same glossiness level, and were excellent in graininess and good in color reproduction.

If a difference of Tmp−Tmt falls outside the above mentioned range, or Mw, Mn or Mw/Mn falls outside the above mentioned ranges, then images have poor gloss uniformity with respect to an image area coverage, as well as poor color reproduction and graininess.

That is, in an image forming method of the present invention, degradation in middle tone of an image quality, which is thought to be caused by a disorder in a transfer electric field or Coulomb repulsion between toners, does not occur, a transfer ratio is good, and further in terms of the recording medium according to the present invention, gloss uniformity, color reproduction and graininess are excellent over all the region from a highlight region through a middle density region to a high density region and in addition no cracking occurs in an image section of a recording medium. Furthermore, a high quality image excellent in color reproduction with good color balance can be achieved and therefore the image forming method is preferably used for image forming in a digital printer, a digital copying machine and the like.

According to an image forming method of the present invention, a toner image is embedded in a transparent resin layer of a recording medium without any irregularity, thereby uniform glossiness can be achieved over all the image area coverage regions, and especially a color image can be achieved further with good color reproduction, good garininess and without any cracking in an image forming surface. A recording medium of the present invention is preferably used, is excellent in color reproduction and graininess of an image, and can produce an image with no cracks in an image forming surface.

What is claimed is:

1. An image forming method comprising the steps of:

forming a toner image on an image carrier;

placing the toner image formed on the image carrier into close contact with a transparent thermoplastic resin layer of a recording medium comprising an opaque base whose surface roughness (Ra) is 1.0 μm or less and the transparent thermoplastic resin layer provided thereon; and heating the toner image brought into close contact therewith to transfer and fix the same on said transparent resin layer.

2. The image forming method according to claim 1, wherein the image carrier is heated to a surface temperature higher than a softening point (Tmt) of toner before said image carrier reaches a toner image transfer position.

3. The image forming method according to claim 1, wherein the recording medium is separated from the toner image carrier when a temperature of the transparent resin of the surface of said recording medium is lower than the softening point (Tmp) by more than 10° C. at a position downstream of said toner image transfer position.

4. The image forming method according to claim 1, wherein said image carrier is heated to a surface temperature higher than a softening point (Tmt) of a toner before said image carrier reaches a toner image transfer position and the recording medium is separated from the toner image carrier when a temperature of the transparent resin of the surface of said recording medium is lower than a softening point (Tmp) of the transparent resin by 10° C. or more at a position downstream of said toner image transfer position.

5. The image forming method according to claim 1, wherein a softening point (Tmp) of the transparent thermoplastic resin provided in the surface of said recording medium is within a difference in a range from +10 to −40° C. of the softening point (Tmt) of said toner.

6. The image forming method according to claim 1, wherein a resin material constituting the transparent resin layer provided in the surface of said recording medium comprises a structural unit of polyester resin base and further comprises polyoxypropylene bis-phenol A and/or glycerin as a polyhydric alcoholic component of said polyester.

7. The image forming method according to claim 1, wherein the base of said recording medium is provided with a white pigment layer on the surface thereof.

8. The image forming method according to claim 1, wherein a surface roughness (Ra) of said opaque base is 0.35 μm or less.

9. A recording medium comprising a transparent thermoplastic resin layer on at least a surface to record an image of a base thereof, wherein the base is opaque and has a surface roughness (Ra) of 1.0 μm or less.

10. The recording medium according to claim 9, wherein a softening point (Tmp) of a resin material constituting said transparent resin layer is within a difference in an range of +10 to −40° C. of the softening point (Tmt) of the toner which is used for forming a toner image.

11. The recording medium according to claim 9, wherein a resin material constituting the transparent resin layer comprises a structural unit of polyester resin base and further comprises polyoxypropylene bis-phenol A and/or glycerin as a polyhydric alcoholic component of said polyester.

12. The recording medium according to claim 9, wherein the base of the recording medium is made of an opaque material.

13. The recording medium according to claim 9, wherein the base of said recording medium is provided with a white pigment layer on the surface thereof.

14. The recording medium according to claim 9, wherein the base of said recording medium has a surface roughness (Ra) of 0.35 μm or less.

* * * * *